US005194060A

United States Patent [19]

Marchetti

[11] Patent Number: 5,194,060

[45] Date of Patent: Mar. 16, 1993

[54] FOLD-AWAY, MULTI-CALF EXERCISE DEVICE

[76] Inventor: Thomas M. Marchetti, 1040 Wayside Rd., Wayside, N.J. 07712

[21] Appl. No.: 846,033

[22] Filed: Mar. 5, 1992

[51] Int. Cl.[5] ..... A63B 21/06

[52] U.S. Cl. ..... 482/97; 482/93; 482/133

[58] Field of Search ..... 482/92, 93, 94, 97, 482/100, 95, 96

[56] References Cited

U.S. PATENT DOCUMENTS

| | | | |
|---|---|---|---|
| 935,854 | 10/1909 | Linerode | 472/108 |
| 1,662,875 | 6/1927 | Young et al. | 472/110 |
| 2,201,036 | 2/1939 | Guerrier | 472/110 |
| 3,344,619 | 8/1982 | Szabo | 272/117 |
| 3,364,747 | 1/1968 | Ebstein | 482/97 |
| 3,850,430 | 11/1974 | Hamilton | 482/97 |
| 4,188,029 | 2/1980 | Bower et al. | 482/97 |
| 4,266,766 | 5/1981 | Calderone | 482/97 |
| 4,346,887 | 8/1982 | Poole | 482/97 |
| 4,572,503 | 2/1986 | Kornhaus | 482/97 |
| 4,813,666 | 3/1989 | Costilow | 482/97 |
| 4,883,270 | 11/1989 | Maag | 272/134 |
| 4,923,195 | 5/1990 | Calderone | 482/97 |

*Primary Examiner*—Richard J. Apley
*Assistant Examiner*—Jerome Donnolly
*Attorney, Agent, or Firm*—Stephen W. White

[57] ABSTRACT

A storable exercise device that can be used to perform a plurality of exercises is described. This device comprises a long shaft having a hingeable element on one end and a means for holding a plurality of weights on the other end. In between are, in order, a seat, a foldable knee lifting device, a foot element, a hooking means and a movable foot rest. This exercise device is particularly useful for exercising the calf muscles of the user. However, a plurality of other devices can be attached to the hooking element that is primarily used to store the device in an upright position against a wall. These other devices can be used to exercise shoulder, back, neck, chest and arm muscles, for example. Since the exercise device of this invention is simple, easy to assemble, storable and relatively inexpensive to manufacture, it has great utility over elements available in the prior art.

6 Claims, 6 Drawing Sheets

16

FOLD-AWAY, MULTI-CALF EXERCISE DEVICE

BACKGROUND OF THE INVENTION

1. Field of the Invention

This invention relates to equipment and devices used to exercise the human body. More particularly, this invention relates to a device that can be used for a plurality of exercises and even more particularly this invention relates to an exercise device for the calf muscles of the human legs. Still more particularly, this invention relates to a multi-calf exercise device that can be easily used and stored in a fold-away position when not in use.

2. Discussion of the Prior Art

Exercise devices that can be used in the development of human muscles are well-known in the prior art. Most of these devices are instruments or machines that are floor-mounted or at the very least break-apart devices that are large and cumbersome. Also known in the prior art are devices which are designed to exercise the human leg and the various muscle components thereof. Most of these devices are also large, cumbersome devices that are difficult to store and are usually floor-mounted. There are very few devices that are designed to specifically exercise the calf muscles in the legs and most people usually exercise these muscles by designing individual exercises during their training routine. Thus, it is common in the prior art for most individuals who wish to exercise their bodies, to attend a gym or some other professional institution where many of these cumbersome, costly and large instruments are found.

Although a few multi-exercise devices are known in the prior art, none are specifically designed to exercise the calf muscles and these instruments are not specifically created for easy storage and use by the individual.

SUMMARY OF THE INVENTION

There is a pressing need within the exercise industry and field for an exercise device that can be easily used to perform a plurality of exercises and can be folded-up and stored when not in use. There is also a pressing need for an exercise device that it is designed to exercise the calf muscles of the human legs. These needs are met in the exercise device of this invention comprising a storable, wall mountable longitudinal shaft having thereon, in order, a hinge element at one end of said shaft, said hinge designed to be mounted to said wall, a seat element in proximity to said hinge, a foldable knee-lifting bar, a foot rest movably located directly under said shaft, a swingable foot element designed to hold said shaft essentially in a parallel position to a floor adjacent to said wall, a hooking element to hold said shaft against said wall, and at the end of said shaft opposite to said hinge, a means to hold a plurality of weight elements thereon.

In a process for exercising the calf muscles of the human body wherein the exercise device above is lowered from a stored position to a user position on the swingable foot and weights are placed on the opposite end of said shaft and said human sits on said seat, places the knees under said padded knee lift bar and the feet on said foot rest and exercises the calf muscles by lifting said shaft and said weights by raising the heels of said feet from the floor.

In yet other embodiments within the scope of this invention, various lifting means can be added on the hooking element using chains, bars and the like and lifting can be accomplished with the hands thus exercising the shoulders, arms and torso muscles.

DETAILED DESCRIPTION OF THE INVENTION

Most conventional exercise equipment available in the prior art is large, cumbersome and expensive. Most of this equipment is designed either to be fixed to the floor for use or assembled and simply placed on the floor. None of these devices are designed to be stored away. There are some devices that can be stored but most of these require that they be assembled and disassembled in order to reach a storable state. Additionally, there are few devices at all which are designed specifically to exercise calf muscles and none of these are foldable or storable. Thus, there is a great need to design a foldable and storable exercise device that can not only exercise the calf muscles specifically but also be used alternatively to exercise other body muscles. A device of this nature can readily be kept within the home negating the necessity of travel to a sports facility with the requisite exercise equipment.

Figure 1:
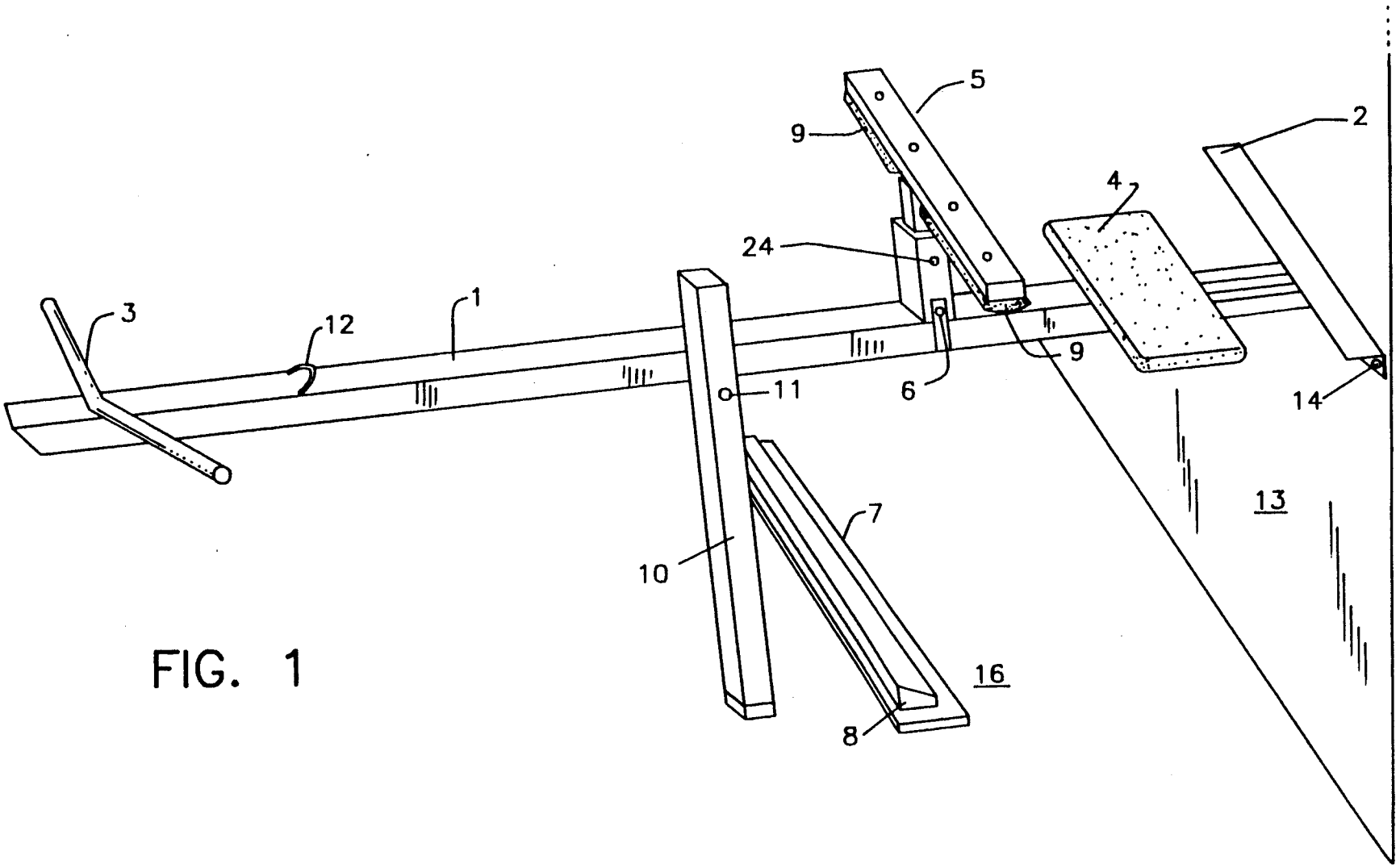
FIG. 1 is a showing of the basic foldable, multi-calf exercising device of this invention.
Figure 3:
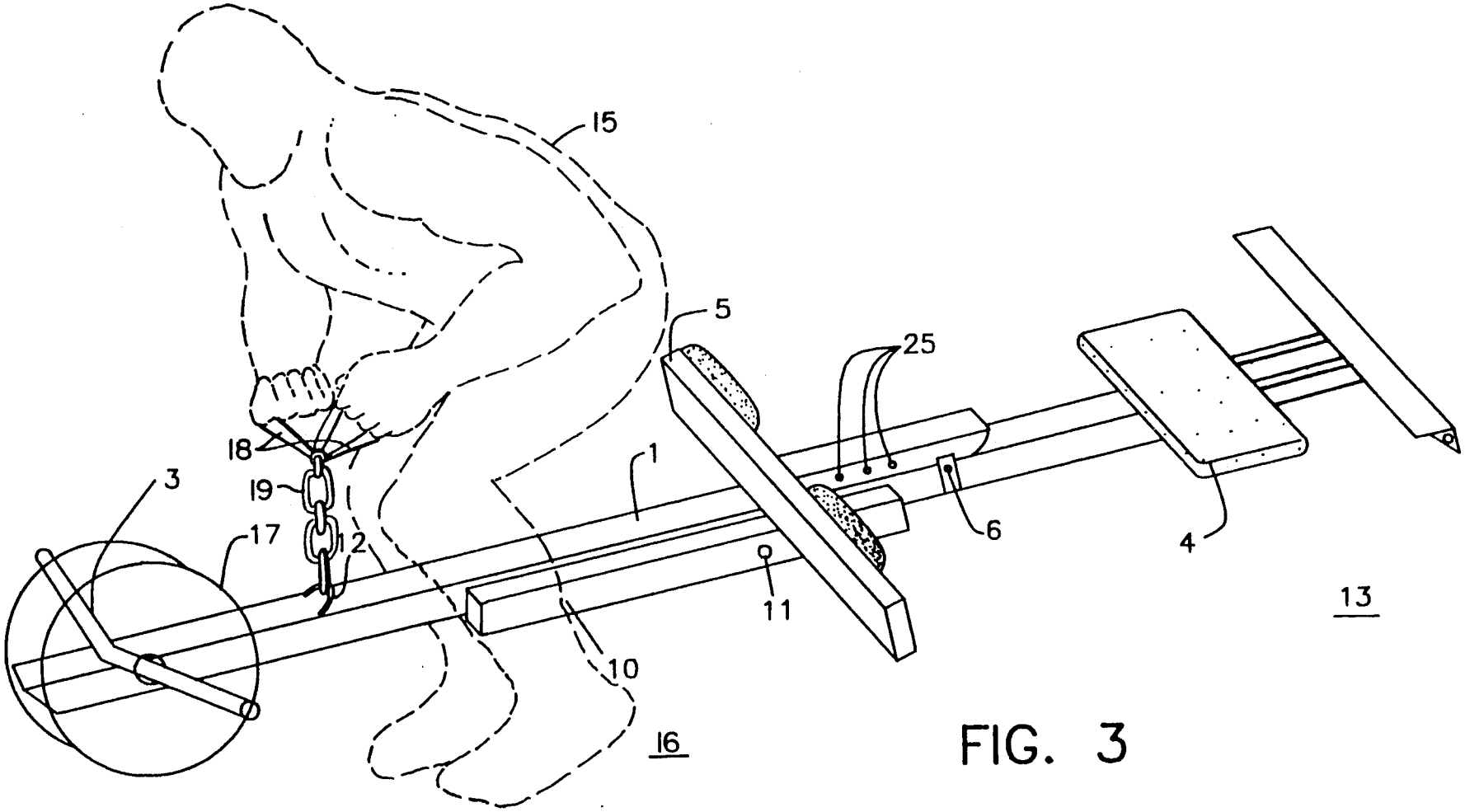
FIGS. 3–5 are showings of various attachments that can be used with the device of this invention to exercise alternative muscles of the body.
Figure 4:
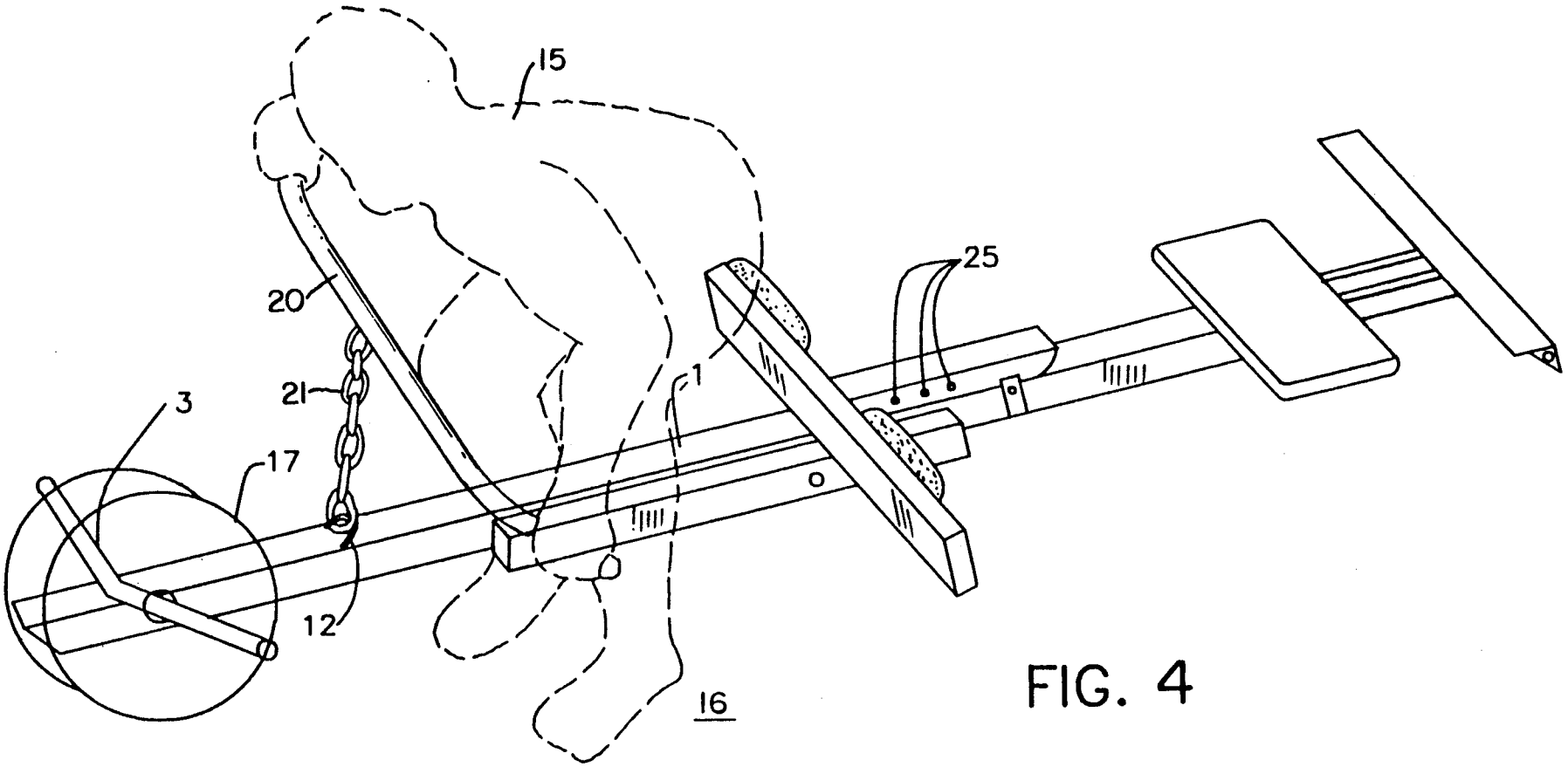
Figure 5:
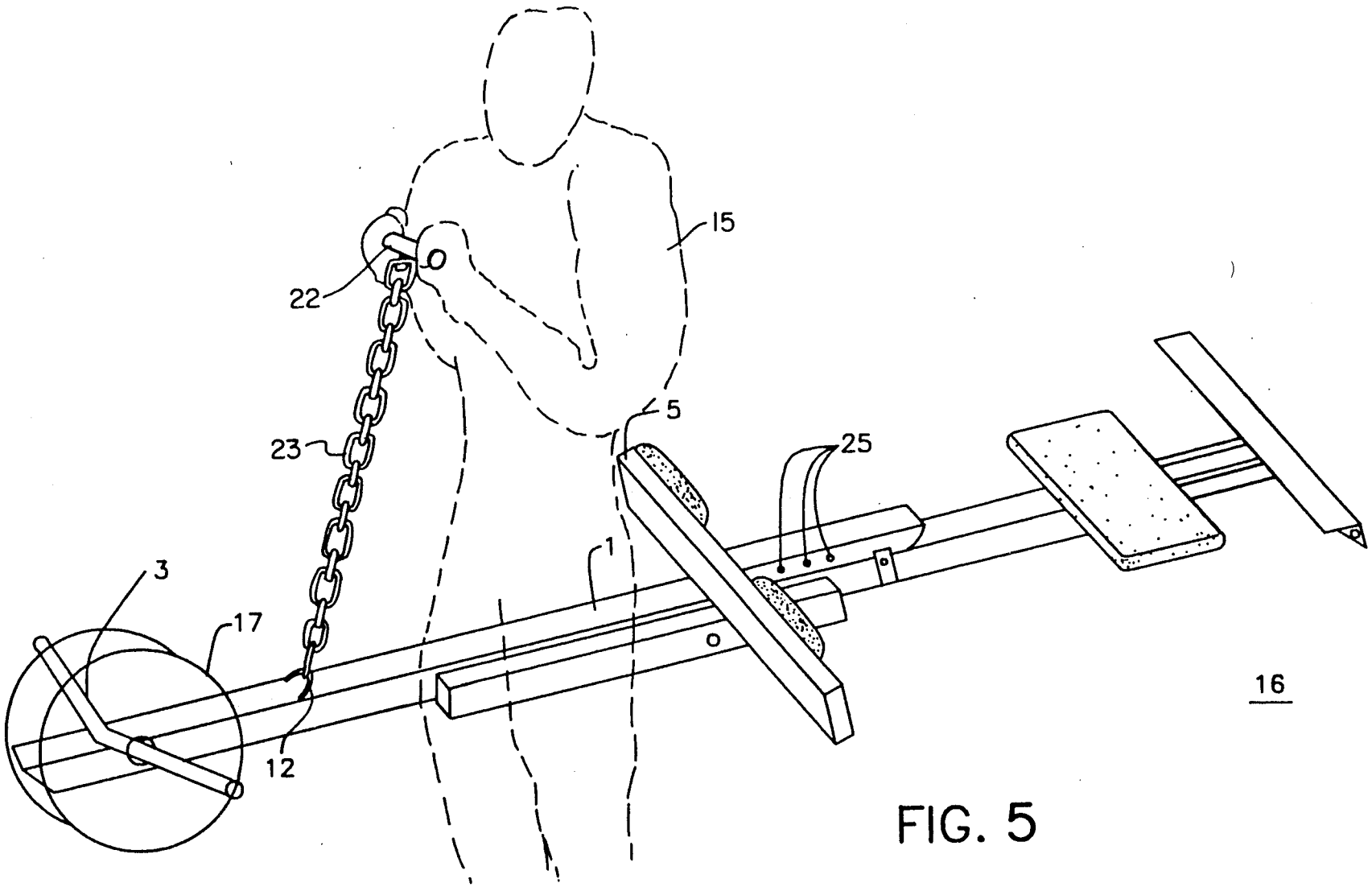

Referring now specifically to the drawings, FIG. 1 is a showing of a particularly preferred exercise device of this invention wherein 1 is a longitudinal shaft that makes up the basic part of this device and from which all parts are integrated therewith. A hinged element 2 is at one end of this shaft and a means for holding a plurality of weights 3 at the opposite end thereof. In this particular showing, the weights are not included attached or inserted on the means 3. Next to hinge 2 is a seat 4 on which the user will sit while performing the requisite calf exercises. Adjacent to seat 4 is a lifting bar 5 that pivots around a pin 6 so that the bar can be folded flat when not in use. The height of bar 5 can be adjusted by removing pin 24 and raising or lowering bar 5 and then reinserting pin 24. Alternate holes 25 for accomplishing this step are shown in FIGS. 3, 4 and 5. Directly underneath bar 5 is a portable foot rest on 7 on which the user will place the feet during use. This foot rest is on the floor 16. In this particular embodiment, the foot rest 7 has a slanted rest 8. Thus, the toe portion of the feet would be placed on this slanted portion and the knees under the lifting bar 5 that can also be padded as shown in this figure as 9. Next, a swingable or foldable foot element 10 is shown in the "down" position on floor 16. This element too can be pivoted on pin 11 while in the stored position. Following along shaft 1 a hooking element is shown as 12. The hooking element is used to mate with a hook (not shown) which would be found in the wall 13 using mounting bolts or screws through hinge 2 one of which is shown as 14 in this Figure. When not in use, the exercise device of this invention can be closed and will then swing up and store flat against the wall surface, for example.

Figure 2:
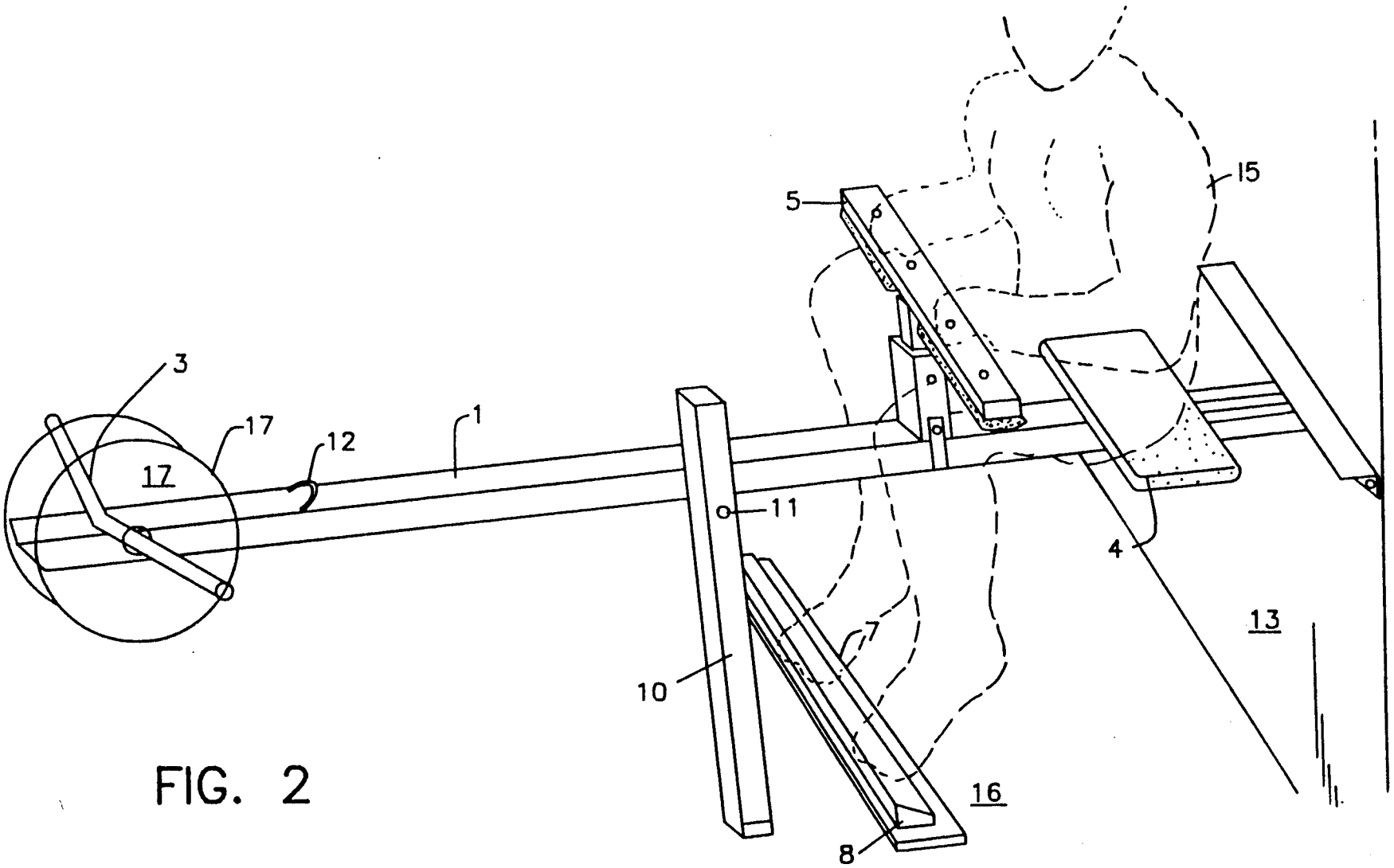
FIG. 2 is another showing of the element of FIG. 1 with the partial outline of a human body imposed thereover and with weights installed.

In FIG. 2, the outline of a human FIG. 15 is shown placed in position on the device of FIG. 1. Here, the figure, or user, is sitting on seat 4 with the knees in position under lifting bar 5. The toes of the user are shown placed on the slanted rest 8 of the foot rest 7 that is on the floor 16. The hands are shown simply resting on lifting bar 5 although the hands are not a function of this particular exercise and could have been shown at the side of the user or at some other resting and convenient location. A series of weights 17 are shown attached to the weight holding means 3 which in this embodiment is simply a bar attached to one end of longitudinal shaft 1. Thus, the weights are shown as conventional lifting weights being a measured weight made from a metal such as iron or steel. These weights have a various weight value depending on just how much the user desires to lift at that time, and are formed in a circular or round wafer like shapes. A hole placed in the center of each weight permits installation by sliding over the bar as shown. In performing the exercise designed for this particular piece of equipment, as shown in FIG. 2, the user raises the heel portion of the foot off the floor. The knees then press against the lifting bar 5 causing the entire shaft 1, including the weights attached thereto, to be raised off the floor 16. The user will repeat these so-called "lifts" as many times as desired and will thus exercise and develop the calf muscles of the legs. This is an extremely useful device for the simple, safe and convenient exercise of said calf muscles. The equipment is sturdy, inexpensive, simple and easily stored up and out of the way after use. When in a stored position, the exercise device shown in these drawings will protrude only 4 inches or so from the wall.

FIG. 3 shows just one of many attachments that can be used in conjunction with the exercise device of this invention to exercise other areas and muscles of the human body. In this showing, the outline of a human FIG. 15 is shown imposed in a crouching position with the legs straddling the longitudinal shaft 1. The hands of this figure or user are shown grasping a pair of close grips 18 further attached by a short chain 19 to the hooking element 12. In this embodiment, the foot element 10 has been pivoted on pin 11 so as to be up and out of the way. The user can then bend over and lift the device of this invention in order to exercise the arm and shoulder muscles. In this showing, the lifting bar 5 has been pivoted around pin 6 so as to be flat against shaft 1. This insures that this particular element will not be in the way when performing the exercise shown in this figure. This particular exercise is known as the "close grip bent-over rows" exercise.

In FIG. 4, the user of FIGS. 3, 15, is shown in crouched position similar to that of FIG. 3. In this showing, the hands are gripping a wide bar 20 attached by a chain 21 to hooking element 12. The remainder of the exercise device is described in FIG. 3 and the proceeding figures. The user lifts the device by a partial straightening of the stance and then pulls the bar up to the chest. This procedure then exercises various back, neck, shoulder and arm muscles and is known as the "wide grip bent-over rows" exercise.

In FIG. 5, the user of FIGS. 3, 15, is shown in a standing position. In this showing the hands are close together gripping a short bar 22 that is attached by a long chain 23 to hooking element 12. The user lifts the device that is described in FIG. 3 and the proceeding figures by the hands and arms alone which will exercise mainly the biceps, forearm and neck muscles and is known as the "standing arm curls" exercise.

Figure 6:
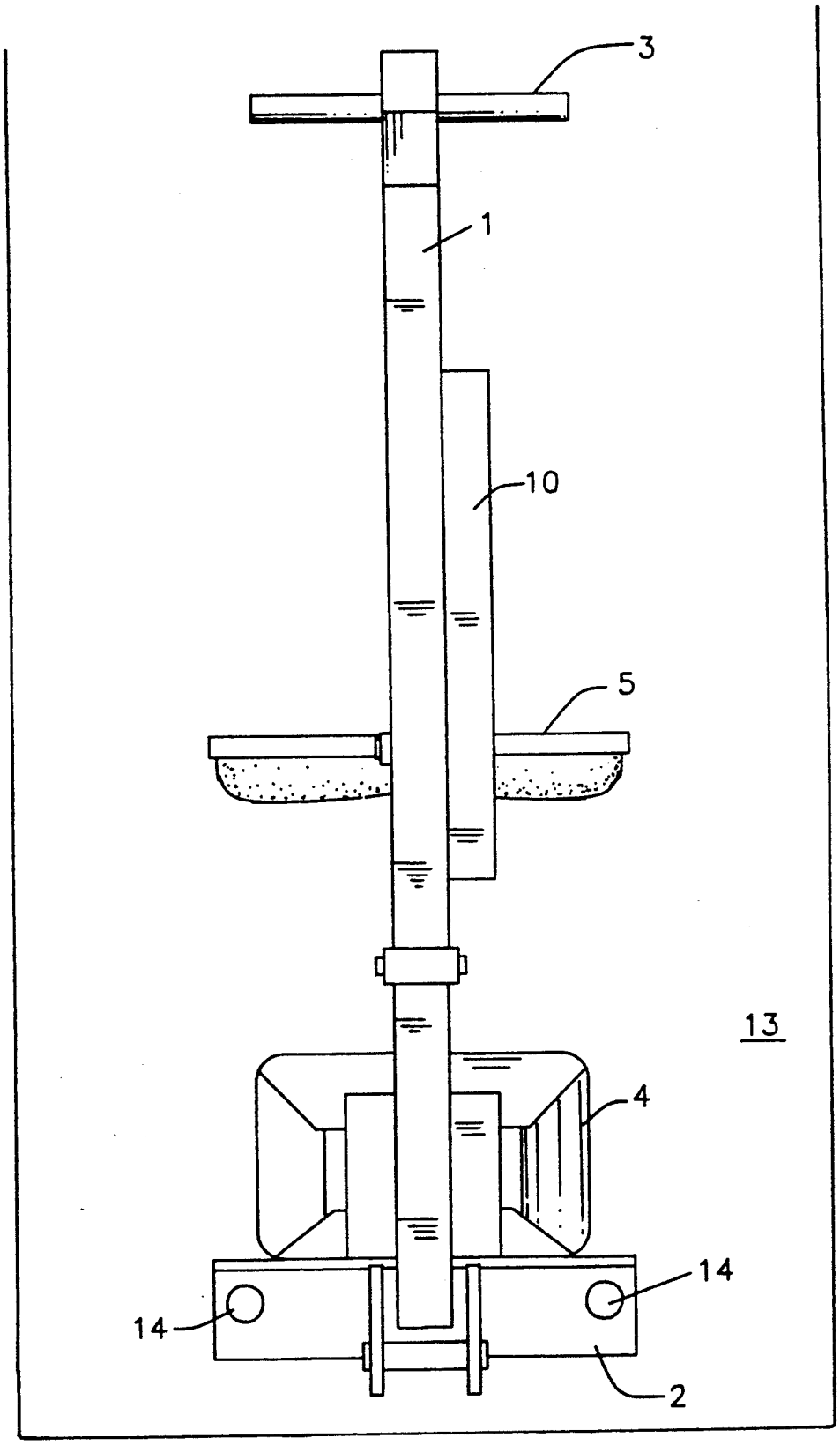
FIG. 6 shows the element of FIG. 1 in a stored position.

In FIG. 6, the exercise device of this invention is shown in a stored position up against wall 13. The hinge 2 is shown attached to the wall 13 with two bolts 14. The seat 4, knee lift 5, shaft 1 and weight holding means 3 are all in the same plane and thus are close to the wall. The lifting bar 5 has been pivoted on the pin related thereto (6, which is not shown in this figure) to insure the device is in a flattened position. The foldable foot element 10 has also been folded up to permit this wall storage position to be achieved. The entire element is held against the wall by a hook (not shown) against which hooking element 12, also not in view in this showing, is attached. Thus, the storage is complete and none of the floor is occupied from this position. This is extremely convenient for the user since the device can be stored as described when not in use. Most of the prior art exercise devices are more complicated and the storing is thus not as convenient. Additionally, none of the prior art elements will perform the much desired calf exercises as described herein.

The device of this invention is conventionally made from iron or steel, although other materials of construction may be employed if those materials exhibit the requisite strength. The seat may be made from wood or plastic if it is desired to have a device that is lighter and easier to store. Padding may be used where desired to insure comfort. For example, the seat and lifting bar under which the knees are placed are padded in the showings of the drawings of this specification, although that is not requisite to the use of the device of the invention. A series of weights of varying weight may be employed as desired. All of the particular embodiments shown in the figures are only those most conventional in the weight lifting art field. Any of the myriad of other devices may be employed equally as well with the device of this invention. All of the portions of the various elements of the device of this invention can be sized as desired. Thus, a shorter user might have a shorter foot element that one for a larger user. If desired, the various swinging portions can be pinned in such a manner as to permit complete removal from the shaft 1. Thus, pins 6 and 11 may comprises from nuts and bolts so that both the swingable foot element 10 and the lifting bar 5 could be completely removed from shaft 1 and either stored separately or replaced by other devices that might fit the individual user's body. The novel, storable exercise device of this invention is particularly useful for the exercise of the calf muscles. However, as described, there are a plurality of other exercises that can be performed adding to the utility thereof.

I claim:

1. A foldable, multicalf exercise device comprising:

a longitudinal shaft having a first end, a second end, a top surface and a bottom surface;

a hinge element mount on said first end and configured to be mounted to an upright, supporting surface;

a seat means mounted on said top surface of said longitudinal shaft, proximate to said first end;

a foldable bar means being located on the top surface of said longitudinal shaft, positioned and configured to allow a user to lift said longitudinal shaft by using their knees while being seated on said seat means in a forward direction facing the second end of said longitudinal shaft;

a foot rest positionable under said longitudinal shaft;

a pivotable, foldable foot element positioned between said first and said second ends of said longitudinal shaft adapted to support said longitudinal shaft in a parallel position with respect to a horizontal surface;

a means to hold a plurality of weighted elements located on said second end of said longitudinal shaft; and, an attachment means configured to aid in securing said longitudinal shaft against said upright supporting surface.

2. The device of claim 1 wherein the attachment means is a hooking element.

3. The exercise device of claim 1 wherein a grip element is attached to said hooking element by a short chain.

4. The exercise device of claim 1 wherein a long bar element is attached to said hooking element by a short chain.

5. The exercise device of claim 1 wherein a short bar element is attached to said hooking element by a long chain.

6. The exercise device of claim 1 wherein a user sits on the seat, places feet on the movable foot rest, places knees under the knee-lifting bar and lifts the weighted shaft using calf muscles.

* * * * *